US012110690B2

(12) United States Patent
Burt et al.

(10) Patent No.: US 12,110,690 B2
(45) Date of Patent: Oct. 8, 2024

(54) BRACKET FOR SUPPORTING ATTACHMENT OF THE END OF A RAILING MEMBER TO A VERTICAL MEMBER

(71) Applicant: Fortress Iron, LP, Garland, TX (US)

(72) Inventors: Kevin T. Burt, Dallas, TX (US); Matthew Carlyle Sherstad, Dallas, TX (US); John David Irick, Dallas, TX (US)

(73) Assignee: Fortress Iron, LP, Garland, TX (US)

( * ) Notice: Subject to any disclaimer, the term of this patent is extended or adjusted under 35 U.S.C. 154(b) by 0 days.

(21) Appl. No.: 17/571,987

(22) Filed: Jan. 10, 2022

(65) Prior Publication Data

US 2022/0127858 A1 Apr. 28, 2022

Related U.S. Application Data

(63) Continuation of application No. 16/805,183, filed on Feb. 28, 2020, now Pat. No. 11,220,824, which is a continuation of application No. 16/655,549, filed on Oct. 17, 2019, now Pat. No. 10,590,656, which is a continuation of application No. 15/078,866, filed on Mar. 23, 2016, now Pat. No. 10,450,758, which is a continuation of application No. 13/729,087, filed on Dec. 28, 2012, now Pat. No. 9,322,180.

(60) Provisional application No. 61/584,878, filed on Jan. 10, 2012.

(51) Int. Cl.
*E04F 11/18* (2006.01)

(52) U.S. Cl.
CPC ..... *E04F 11/1834* (2013.01); *E04F 11/1836* (2013.01); *E04F 2011/1819* (2013.01)

(58) Field of Classification Search
CPC ... E04F 11/1834; E04F 11/1836; E04F 11/14; E04F 11/1802; E04F 11/1804; E04H 17/1417; E04H 17/1421; E04H 17/1434; E04H 17/1443
See application file for complete search history.

(56) References Cited

U.S. PATENT DOCUMENTS

| | | | | |
|---|---|---|---|---|
| 5,026,028 | A | 6/1991 | Ooi et al. | |
| 5,547,169 | A | 8/1996 | Russell | |
| 6,053,481 | A | 4/2000 | Scheide | |
| 6,543,751 | B1 | 4/2003 | Spruill | |
| 6,805,335 | B2 | 10/2004 | Williams | |
| 6,993,843 | B2 * | 2/2006 | Quaintance ..... | E04F 11/181 29/897.31 |
| 7,731,160 | B2 | 6/2010 | Terrels et al. | |
| 8,936,233 | B1 | 1/2015 | Sneith | |
| 9,322,180 | B2 | 4/2016 | Burt et al. | |
| 2003/0030048 | A1 | 2/2003 | Quaintance et al. | |
| 2003/0127575 | A1 | 7/2003 | Forbis | |
| 2003/0164486 | A1 | 9/2003 | West | |

(Continued)

*Primary Examiner* — Daniel J Wiley
(74) *Attorney, Agent, or Firm* — Foley & Lardner LLP; John J. May

(57) ABSTRACT

A railing bracket including a cup having a bottom wall, a first side wall, a second side wall disposed opposite the first side wall, and a notch. The first side wall defines a first countersunk through hole configured to receive a fastener. A U-shaped cap has a top wall, a first lateral wall, a second lateral wall, and a tab. The first lateral wall is configured to cover a head of the fastener and the notch is configured to receive the tab.

20 Claims, 7 Drawing Sheets

(56) References Cited

U.S. PATENT DOCUMENTS

| | | | |
|---|---|---|---|
| 2005/0051761 | A1 | 3/2005 | Caissie et al. |
| 2005/0285091 | A1 | 12/2005 | Ko |
| 2006/0033093 | A1 | 2/2006 | Lo |
| 2006/0175594 | A1 | 8/2006 | Burkart et al. |
| 2007/0131920 | A1 | 6/2007 | Platt |

* cited by examiner

BRACKET FOR SUPPORTING ATTACHMENT OF THE END OF A RAILING MEMBER TO A VERTICAL MEMBER

PRIORITY CLAIM

This application is a continuation of U.S. patent application Ser. No. 16/805,183, filed Feb. 28, 2020, which is a continuation of U.S. patent application Ser. No. 16/655,549, filed Oct. 17, 2019, now U.S. Pat. No. 10,590,656, which is a continuation of U.S. U.S. patent application Ser. No. 15/078,866, filed Mar. 23, 2016, now U.S. Pat. No. 10,450,758, which is a continuation of U.S. patent application Ser. No. 13/729,087, filed Dec. 28, 2012, now U.S. Pat. No. 9,322,180, which claims priority from U.S. Provisional Application for Patent No. 61/584,878 filed Jan. 10, 2012, the disclosures of which are hereby incorporated by reference.

BACKGROUND

Technical Field

The present invention relates generally to hardware associated with attaching the end of a railing member to a vertical member and more particularly to a bracket for use in securing the end of a railing member to a vertical member with a user selectable vertical or horizontal angular position. The railing member can comprise a hand rail, a rail of a fence panel, or any other structural member.

Description of Related Art

When installing a railing, the end of the railing must be attached to a vertical member such as a post (or perhaps a wall). If the railing is horizontal and oriented perpendicular to the face of the vertical member, this attachment is quite easy to accomplish using conventional techniques requiring little skill. Difficulties in attachment arise, however, when the railing has a non-horizontal and/or non-perpendicular orientation. Measuring and making the proper angle cuts to the end of the railing can be tricky, and there may be difficulties or complications with respect to securely attaching the angle-cut end of the railing to the vertical member.

It is known in the art to use a bracket mounted to the vertical member to receive the end of the railing and assist in attaching the end of the railing to the vertical member. However, such a bracket (typically having a configuration and operation similar to that of a joist hanger used in housing construction) solely supports a horizontal and perpendicular orientation for attaching the end of the railing to the vertical member. The bracket is accordingly of little or no use when the railing installation requires attachment of the end of the railing to the vertical member at an angle formed in either the vertical or horizontal plane.

Another concern with such prior art brackets is that the mounting hardware (such as the bracket itself and its associated attachment screws) remains visible after installation. In many railing installation jobs, visibility of the mounting means and the bracket following completion of the installation is undesirable. It is for this reason that installers often prefer to use the conventional installation techniques when attaching the end of the railing to the vertical member. However, there is an associated increase in cost due to manpower skill and hours to achieve a more aesthetically pleasing installation through the use of conventional installation techniques (especially when the installation requires the making of an angle cut).

There would be an advantage if a bracket were available for attaching the end of a railing to a vertical member at a user selectable angle in either the vertical or horizontal plane. There would further be an advantage if the visibility of the mounting hardware for that bracket (in either an angled or perpendicular installation) could be minimized.

SUMMARY

In accordance with an embodiment, an apparatus comprises a cup adapted to receive an end of a railing member; and a cap adapted to cover the cup. The cup is configured to receive the cap in both of a first orientation wherein the cap is installed over a top of the cup and a second orientation wherein the cap is installed under a bottom of the cup. The cup is mountable to a vertical member in a perpendicular configuration. Furthermore, through the use of a pivoting mechanism, the cup is mountable to the vertical member with a user selectable vertical or horizontal angular position.

In an embodiment, an adjustable railing bracket comprises a rail receiving member having a bottom wall, a plurality of side walls, and a back wall, the rail receiving member configured to support a rail therein; and a hinge assembly configured to be coupled to the rail receiving member in at least two orientations which allow for rotation of the rail receiving member about a hinge axis of the hinge assembly. The orientations include: a first orientation wherein rotation of the rail receiving member about the hinge axis of the hinge assembly is in a vertical plane; and a second orientation wherein rotation of the rail receiving member about the hinge axis of the hinge assembly is in a horizontal plane.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 2:
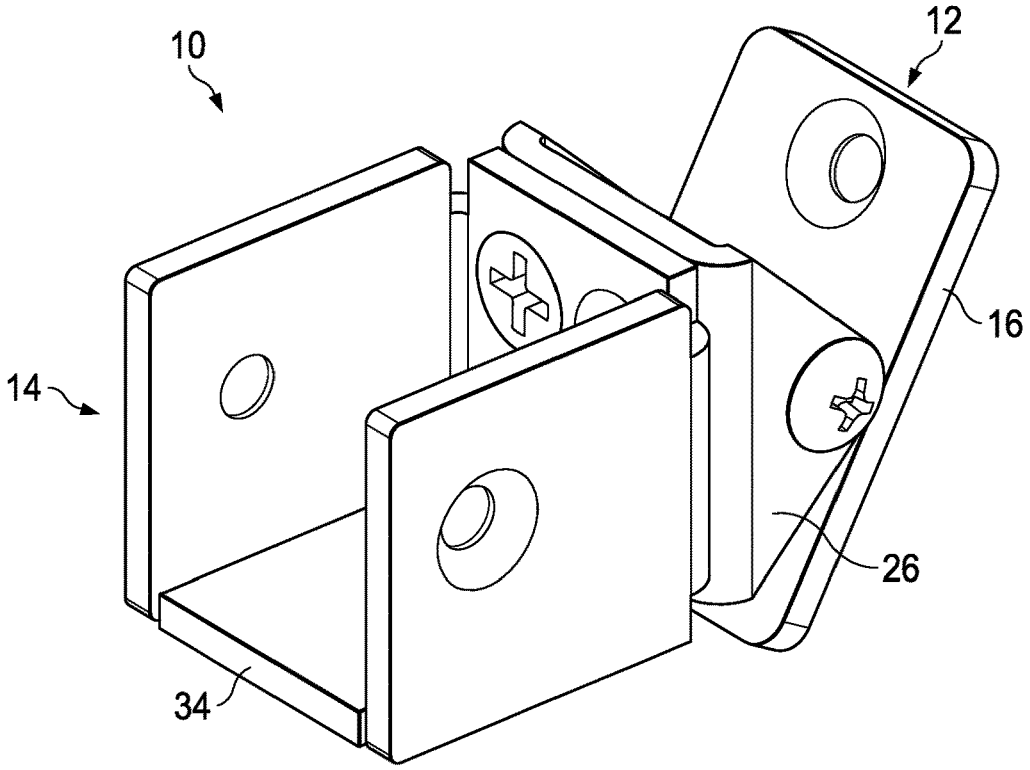
FIG. 2 is an isometric view of an assembled adjustable-angle railing bracket to support selection of a vertical attachment angle between the railing member and vertical member.

Reference is first made to FIG. 2, which shows an isometric view of an assembled adjustable-angle railing bracket 10. The bracket 10 includes a cup 14 that is configured to receive an end of a railing member. The bracket 10 further includes a hinge assembly 12 that is configured to attach to a vertical member (such as a post or wall). The cup 14 is attached to the hinge assembly 12 in a configuration such that the bracket supports selection of a vertical attachment angle between the railing member and vertical member.

Figure 3:
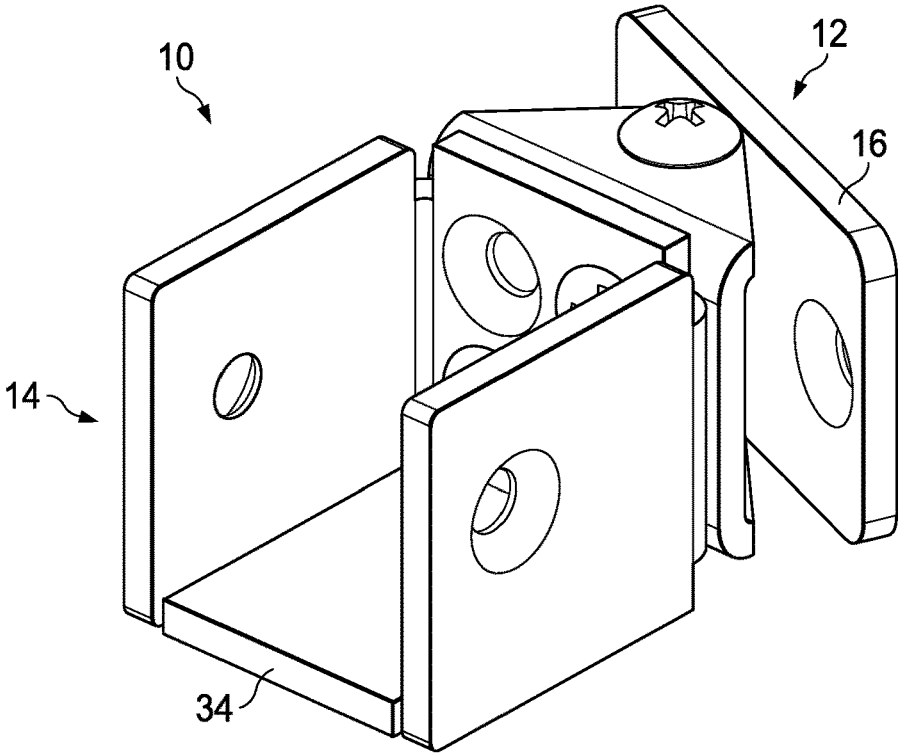
FIG. 3 is an isometric view of an assembled adjustable-angle railing bracket to support selection of a horizontal attachment angle between the railing member and vertical member.

Reference is next made to FIG. 3, which shows an isometric view of an assembled adjustable-angle railing bracket 10. The bracket 10 includes a cup 14 that is configured to receive an end of a railing member. The bracket 10 further includes a hinge assembly 12 that is configured to attach to a vertical member (such as a post or wall). The cup 14 is attached to the hinge assembly 12 in a configuration such that the bracket supports selection of a horizontal attachment angle between the railing member and vertical member.

The term "rail", "railing" or "railing member" as used herein refers to any structural member to be attached to a vertical member. Examples of included railing members include a hand rail, a rail of a fence panel or other barrier, and the like.

It will be noted that the component parts of the bracket shown in FIGS. 2 and 3 are the same. The only difference between FIGS. 2 and 3 is the orientation with which the cup 14 has been attached to the hinge assembly 12. In FIG. 2, the attachment orientation configures the hinge assembly 12 to support pivoting movement of the cup 14 in a vertical plane. Conversely, the attachment orientation in FIG. 3 configures the hinge assembly 12 to support pivoting movement of the cup 14 in a horizontal plane. Thus, an installer can utilize the same bracket 10 in connection with making an angled attachment of the railing member to the vertical member where the angle of such angled attachment is formed in vertical plane (such as with a stair or ramp installation) or horizontal plane (such as with turning a non-perpendicular corner).

Figure 1:
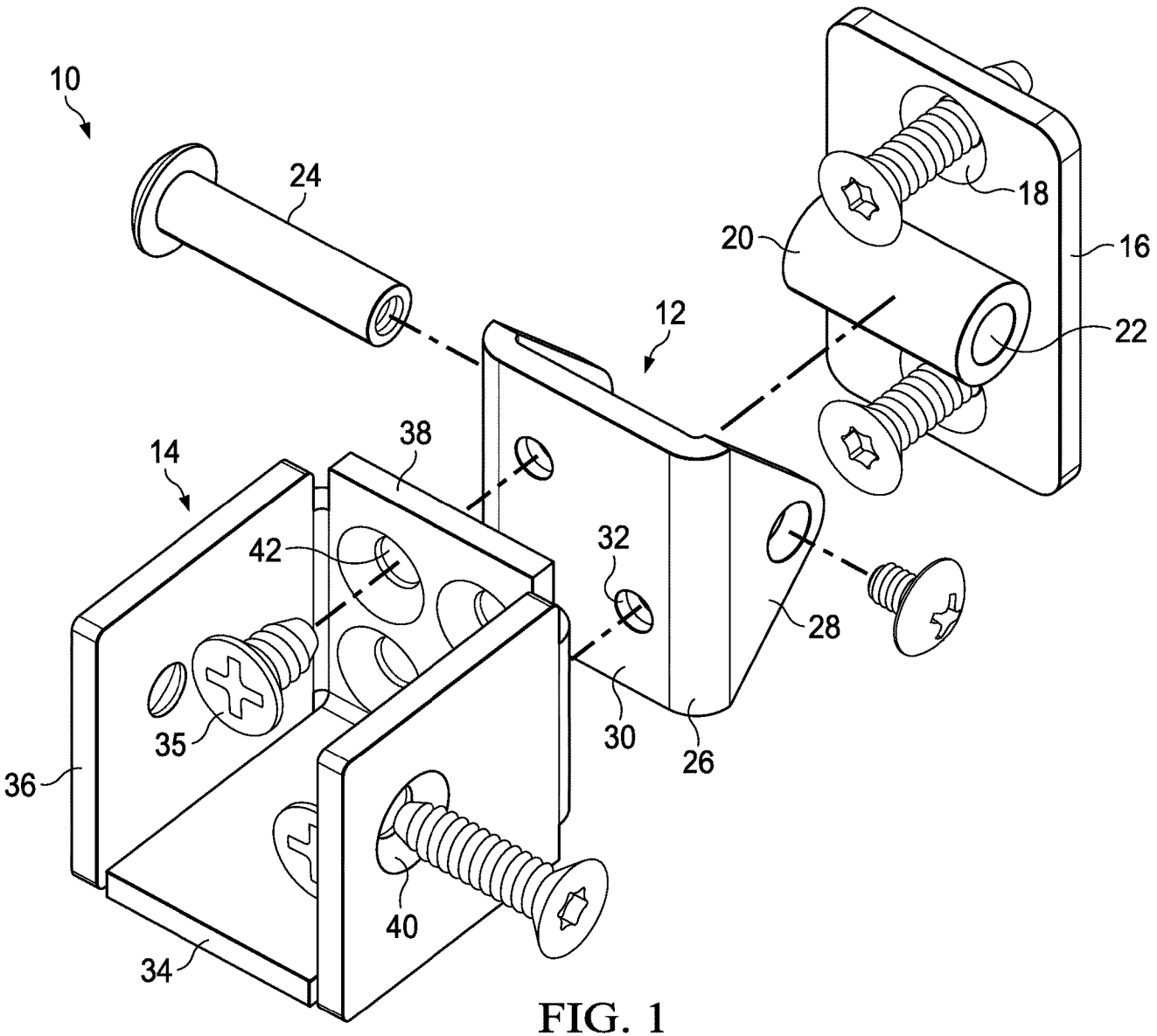
FIG. 1 shows an exploded perspective view of an adjustable-angle railing bracket.

FIG. 1 shows an exploded perspective view of the bracket 10. Specifically, FIG. 1 shows the orientation for attachment of the hinge assembly 12 relative to the cup 14 as shown in FIG. 2 for supporting pivoting movement of the cup 14 in a vertical plane. It will be understood that the attachment orientation of the hinge assembly 12 relative to the cup 14 as shown in FIG. 3 is accomplished by simply rotating the hinge assembly 12 by ninety degrees relative to the cup 14 so as to support pivoting movement of the cup 14 in a horizontal plane.

The cup 14 is formed from a sheet of material (for example, 12 gauge steel) that is stamp cut into a T-shape and folded along three lines to present four adjacent sides of a cube-like structure. The four adjacent sides of the cup 14 comprise a bottom wall 34, a pair of opposed side walls 36, and a back wall 38. The pair of opposed side walls 36 and back wall 38 extend perpendicularly from the bottom wall 34 at the fold lines.

The bottom wall 34 provides a primary support for receiving the end of a railing member. The weight of the railing and any downward force on the railing is opposed, at least in part, by the bottom wall 34.

The side walls 36 provide for lateral retention of the received end of the railing member. At least one of the side walls 36, and in a preferred embodiment both side walls, includes a countersunk hole 40. The hole 40 supports insertion of a mounting screw through the hole for attachment to a side of the railing member (not shown). This attachment may be made into and through the side of the railing member (using an opening therein) or alternatively against the side surface of the railing member (such as with the use of a set screw). Thus, using the hole 40 and associated mounting screw, the side walls 36 further function to restrain longitudinal movement of the received railing member (i.e., removal of the end of the railing member from the cup 14).

The back wall 38 of the cup 14 includes a plurality of countersunk holes 42. In certain embodiments, four countersink holes 42 may be provided in the backwall 38. The holes 42 support insertion of a mounting screw through each of two or more of the holes 42 so as to support attachment of the cup 14 to the hinge assembly 12. In a perpendicular installation, the holes 42 are used to receive screws for attachment of the cup 14 directly to a vertical member without need for the hinge assembly. It will be understood that in either implementation, mounting screw attachment is just one available means for attachment. It will thus be understood that the back wall 38 can be attached, for example, using permanent or non-permanent attachment means. An example of a permanent attachment means would comprise a weld (for example, a weld between the back wall 38 and the surface of a vertical member, or a weld between the back wall 38 and the hinge assembly 12).

The hinge assembly 12 comprises a back plate 16. The back plate 16 is formed from a sheet of material (for example, 12 gauge steel) that is stamp cut into a square or rectangular shape. A plurality of holes 18 are formed in the back plate 16. The holes 18 support insertion of a mounting screw through each hole for attachment to a vertical member (not shown). In this way, the hinge assembly 12 of the bracket 10 can be securely attached to the vertical member.

The hinge assembly 12 further comprises a barrel 20 that is secured to a front surface of the back plate 16. In an embodiment, the barrel 20 may comprise a cylindrical structure that is attached, for example by welding, to the front surface of the back plate 16. In another embodiment, the barrel 20 may be formed integrally by the back plate 16. In either configuration the barrel 20 defines a through hole 22 for supporting pivoting action by the hinge assembly 12. Means other than the use of barrel can be used to define the through hole 22.

The hinge assembly 12 still further comprises a pivoting member 26. The pivoting member 26 is formed from a sheet of material (for example, 12 gauge steel) that is stamp cut into a generally elongate-shape and folded along two lines to present three adjacent sides of a U-shaped structure. The three adjacent sides of the pivoting member 26 comprise a pair of ears 28 and a center plate 30. The ears 28 extend perpendicularly from the center plate 30 at the fold lines. The ears 28 have a tapered or triangular shape. An aligned pair of openings is formed in the pair of ears 28. A distance between the ears 28 is slightly larger than a length of the barrel 20 and its through hole 22. In the assembled hinge assembly 12, the pair of openings in the ears 28 are aligned with the through hole 22. A pivot pin 24 is inserted through the pair of openings in the ears 28 and through hole 22 to define a hinge mechanism which permits the pivoting member 26 to angularly pivot relative to the back plate 16. The pivot pin may have any one of a number of configurations including a screw-like configuration as shown, or a simpler shaft with a cotter, hitchpin or hairpin securing mechanism.

It will accordingly be recognized that the tapered or triangular shape of the pair of ears 28 provides freedom of pivoting movement while simultaneously providing structural support and integrity of the hinge assembly 12. In a preferred implementation, the tapered or triangular shape of the pair of ears 28 permits the pivoting member 26 to rotate from a center position (where the center plate 30 of the pivoting member is approximately parallel to the back plate 16) plus or minus about forty-five degrees in the plane of movement relative to the back plate 16 (i.e., horizontal or vertical depending on the installed orientation of the cup 14 relative to the hinge assembly 12). Thus, the pivoting member 26 has an approximate ninety degree angle of throw.

The center plate 30 of the pivoting member 26 includes a plurality of tapped holes 32. In a preferred implementation, two diagonally offset holes 32 are provided. The holes 32 align with certain ones of the plurality of countersunk holes 42 found in the back wall 38 of the cup 14. The holes 42 support insertion of a mounting screw therethrough to engage the tapped holes 32 of the center plate 30 and thus permit the cup 14 to be securely attached to the hinge assembly 12. As shown, the tapped holes 32 are located proximate an opposite corner of the center plate 30 in order to secure opposite diagonal corners of the backwall 38 of the cup 14.

Importantly, the provision of aligned holes 42 and tapped holes 32 in the manner illustrated in FIG. 1 permits the attachment of the cup 14 to the hinge assembly 12 in either the orientation shown in FIG. 2 (which supports pivoting movement of the cup 14 in a vertical plane) or the orientation shown in FIG. 3 (which supports pivoting movement of the cup 14 in a horizontal plane). Changing the configuration of the bracket 10 between vertical and horizontal plane installation support simply requires removal of the mounting screws from the holes 42 and tapped holes 32, rotation of the cup 14 relative to the hinge assembly 12 by ninety degrees to a new orientation, and reinsertion and tightening of the mounting screws through the holes 42 and tapped holes 32 at the new orientation.

With reference once again to FIG. 2, the cup 14 is configured to pivot vertically with respect to the back plate 16 of the hinge assembly 12. This functionality may be particularly important when using the bracket 10 to secure a railing of a stairway. In this application, the cup 14 of the bracket 10 may be pivoted downward at a selected angle up to approximately 45 degrees to be in position to receive a top end of a stairway railing. Alternatively, the cup 14 of the bracket 10 may be pivoted upward at a selected angle up to approximately 45 degrees to be in position to receive a bottom end of a stairway railing. The pivot axis and the bottom wall are generally parallel to each other in this vertical adjustable-angle configuration.

With reference once again to FIG. 3, the same bracket 10 may be installed such that the pivot axis defined by the pivot pin 24 and the bottom wall 34 of the cup 14 may be generally perpendicular to each other. This configuration may be particularly useful in a miter railing installation where a horizontal railing may be secured to a fence post at a horizontal angle to turn a non-perpendicular corner. To create this configuration, the hinge assembly 12 may be rotated approximately 90 degrees with respect to the cup 14. The cup 14 may be secured with screws as received through the countersunk holes 42 into the tapped holes 32 of the pivoting member 26. Thus, the bottom wall 34 of the cup 14 may remain parallel to the ground, but the pivot axis of the hinge assembly may be perpendicular to the ground to enable side-to-side rotation of the cup 14 and its corresponding railing.

Figure 4:
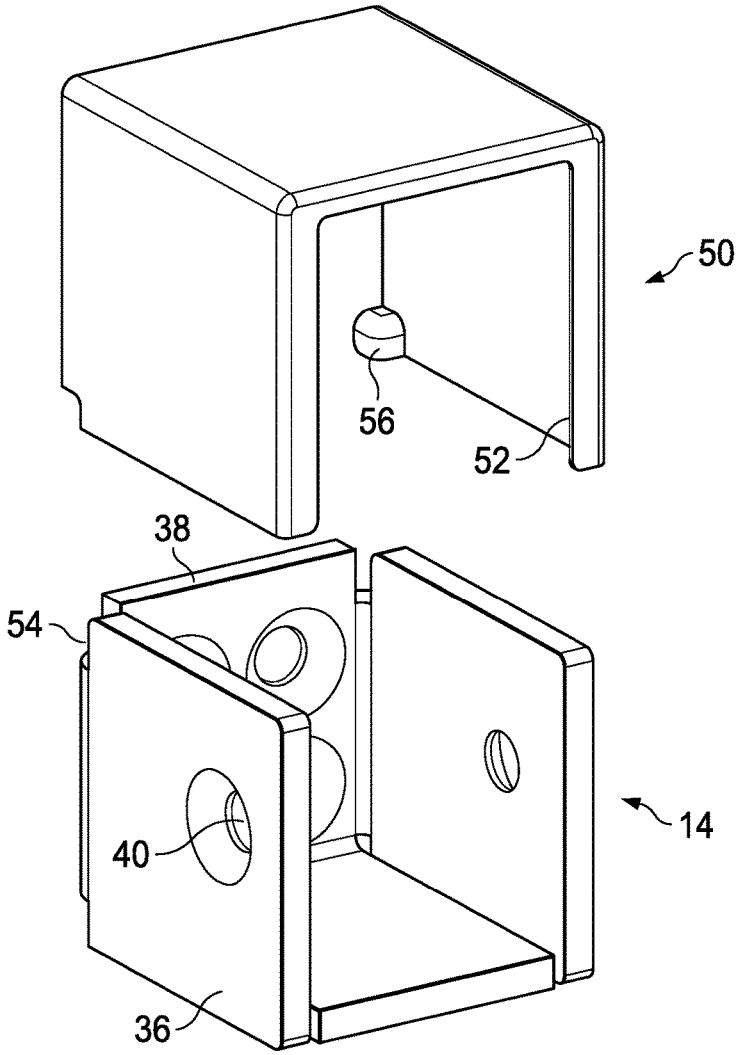
FIG. 4 illustrates an exploded view of a cup for the adjustable-angle railing bracket with a cap.

Reference is now made to FIG. 4 which illustrates an exploded view of an embodiment of the cup 14 for the bracket 10 with a cap 50. For the sake of clarity, the cup 14 is shown without the associated and attached hinge assembly 12 (see, FIGS. 1-3) and so as to emphasize that the cup 14 is further useful without the hinge assembly 12 for supporting a perpendicular railing installation. The cap 50 serves as a cover to hide the countersunk holes 40 and screws received therethrough to secure the received end of the railing (not shown). The cap 50 accordingly provides an aesthetically pleasing finished railing assembly covering the included attachment hardware. The cap 50 is made of any suitable material including molded plastic or stamped sheet metal. If made of stamped sheet metal, the stamped structure of the cap 50 comprises a generally elongate-shape that is folded along two lines to present three adjacent sides of a U-shaped structure.

A front of the cap 50 includes an inwardly extending flange portion 52. A back of the cap 50, at a distal end corner of the side walls of the cap, includes one or more inwardly extending tab members 56. Each rear corner of the cup 14 is provided with a notch 54 (see, FIG. 5 illustrating a rear assembled view).

When the cap 50 is inserted over the cup 14, the inwardly extending flange portion 52 is provided to cover an edge of the cup 14 material, the walls of the cap are provided to cover the side walls 36 (openings 40 and associated screws) of the cap as well as the open top portion of the cup, and the inwardly extending tab members 56 engage the bottom notches 54 of the cup (with such engagement serving to securely attach the cap 50 to the cup 14). The combination of the inwardly extending tab members 56 and inwardly extending flange portion 52, when the cap 50 is attached to the cup 14, further serve to restrain back-and-forth motion of the cap with respect to the cup.

Figure 5:
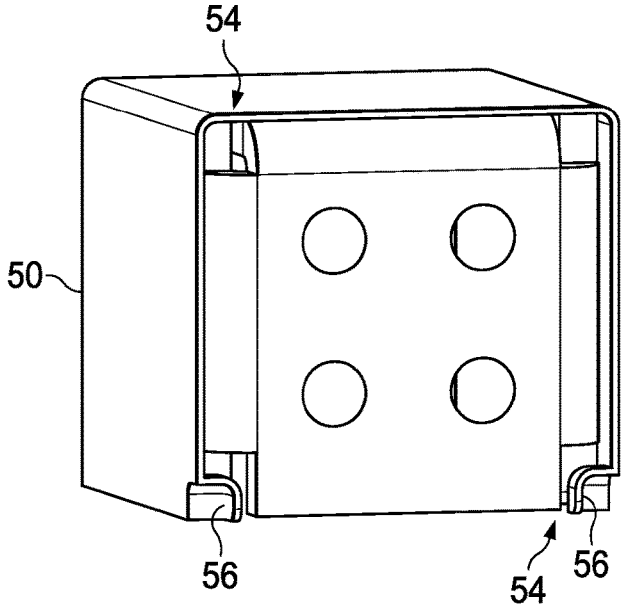
FIG. 5 illustrates a rear assembled view of a cup for the adjustable-angle railing bracket with a cap.

While FIG. 5 illustrates the attachment of the cap 50 over the top of the cup 14, it will be understood that the provision of notches 54 at each rear corner of the cup 14 supports attachment of the cap 50 under the cup 14. When the cap 50 is inserted under the cup 14, the inwardly extending flange portion 52 is still provided to cover an edge of the cup 14 material, and the inwardly extending tab members 56 instead engage the top notches 54 of the cup (with such engagement serving to securely attach the cap 50 to the cup 14). In this assembled configuration, the walls of the cap 50 are provided to cover the side walls 36 (openings 40 and associated screws) of the cap as well as the bottom wall 34 of the cup. The combination of the inwardly extending tab members 56 and inwardly extending flange portion 52, when the cap 50 is attached to the cup 14, further serve to restrain back-and-forth motion of the cap with respect to the cup. This particular assembly of the cap 50 to the cup 14 is particularly useful when an additional member is attached to a top of the received railing member (thus permitting a flush assembly without interference from the cap 50 will still permitting the cap to serve its aesthetic function of covering the hardware associated with the cup and retention of the received end of the railing member).

Figure 7:
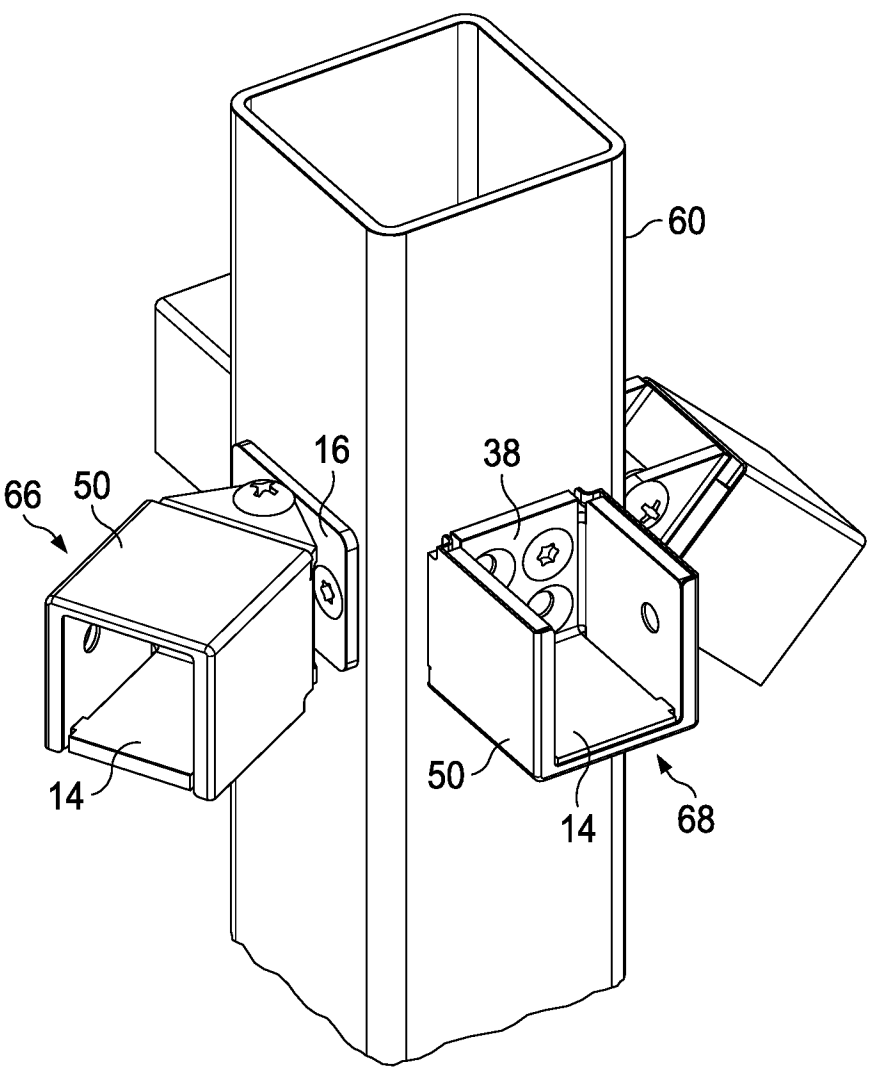
FIGS. 6 and 7 illustrate attachment of the adjustable-angle railing bracket to a vertical member.
Figure 6:
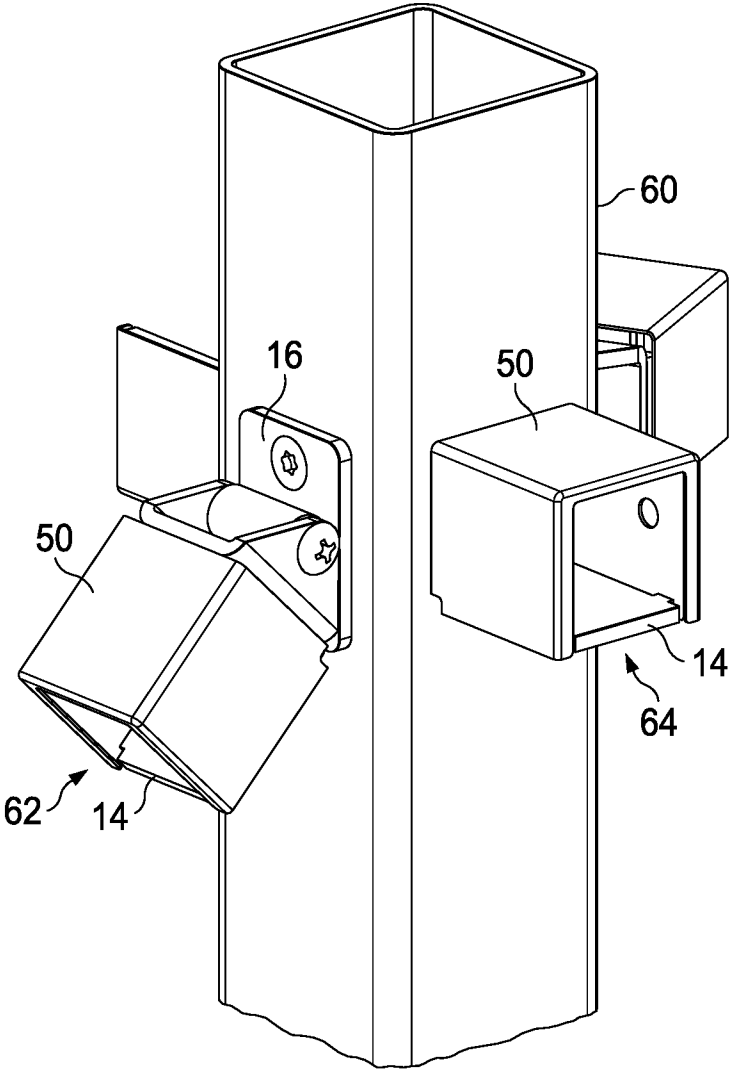

Reference is now made to FIGS. 6 and 7, which show a variety of attachment configurations for the adjustable-angle railing bracket 10 as secured to a vertical member, such as post 60.

FIG. 6 shows a configuration 62 of the bracket 10 as secured to the post 60 in a manner which permits adjustable angle positioning in the vertical plane. The configuration 62 further shows the cap 50 installed in an overhead position (i.e., attached over the top of the cup 14). It will be understood, according to alternative installations, that configuration 62 may not include a cap 50 or the cap 50 may instead be fitted to the cup in an underneath configuration (i.e., attached under the cup 14). The backplate 16 of the hinge assembly is secured, for example by screws, to the surface of the post 60. Alternatively, the backplate 16 is secured to the surface of the post 60 in a more permanent manner using, for example, a weld or adhesive.

FIG. 6 further illustrates a configuration 64 in which the cup 14 is secured directly to the post 60. The configuration 64 accordingly illustrates use of the cup 14 to support a horizontal installation perpendicular to the vertical surface of the post 60. Similar to configuration 62, the cap 50 is installed in an overhead position (i.e., attached over the top of the cup 14). It will be understood, according to alternative installations, that configuration 64 may not include a cap 50 or the cap 50 may instead be fitted to the cup in an underneath configuration (i.e., attached under the cup 14). The back wall 38 of the cup is secured, for example by screws, to the surface of the post 60. Alternatively, the back wall 38 of the cup is secured to the surface of the post 60 in a more permanent manner using, for example, a weld or adhesive.

FIG. 7 shows a configuration 66 of the bracket 10 as secured to the post 60 in a manner which permits adjustable angle positioning in the horizontal plane. The configuration 66 further shows the cap 50 installed in an overhead position (i.e., attached over the top of the cup 14). It will be understood, according to alternative installations, that configuration 66 may not include a cap 50 or the cap 50 may instead be fitted to the cup in an underneath configuration (i.e., attached under the cup 14). The backplate 16 of the hinge assembly is secured, for example by screws, to the surface of the post 60. Alternatively, the backplate 16 is secured to the surface of the post 60 in a more permanent manner using, for example, a weld or adhesive.

FIG. 7 further illustrates a configuration 68 in which the cup 14 is secured directly to the post 60. The configuration 68 accordingly illustrates use of the cup 14 to support a horizontal installation perpendicular to the vertical surface of the post 60. The configuration 68 shows the cap 50 installed in an underneath position (i.e., attached under the cup 14). It will be understood, according to alternative installations, that configuration 68 may not include a cap 50 or the cap 50 may instead be fitted to the cup in an overhead position (i.e., attached over the top of the cup 14). The back wall 38 of the cup is secured, for example by screws, to the surface of the post 60. Alternatively, the back wall 38 of the cup is secured to the surface of the post 60 in a more permanent manner using, for example, a weld or adhesive.

Figure 8:
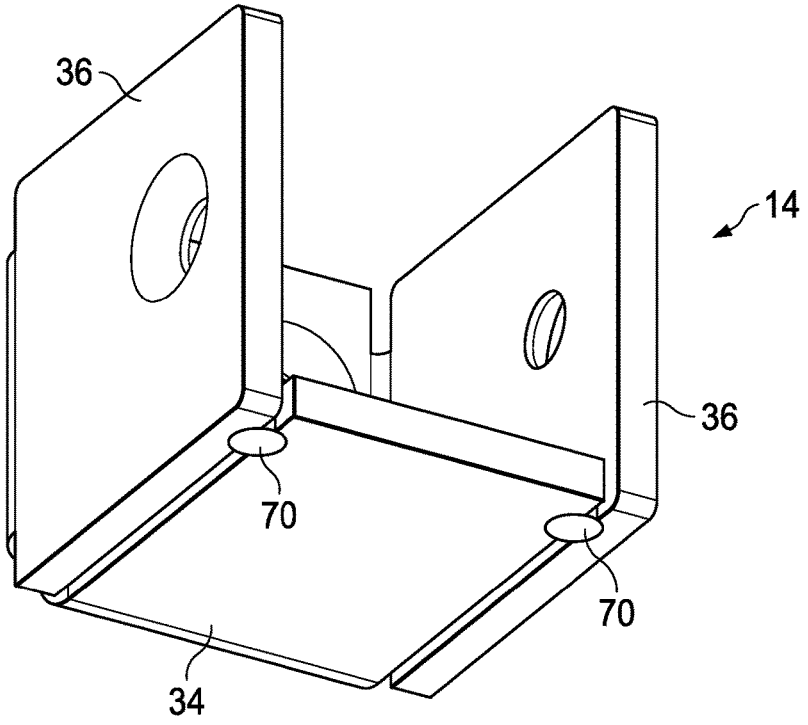
FIGS. 8 and 9 show isometric views of the cup for the adjustable-angle railing bracket.
Figure 9:
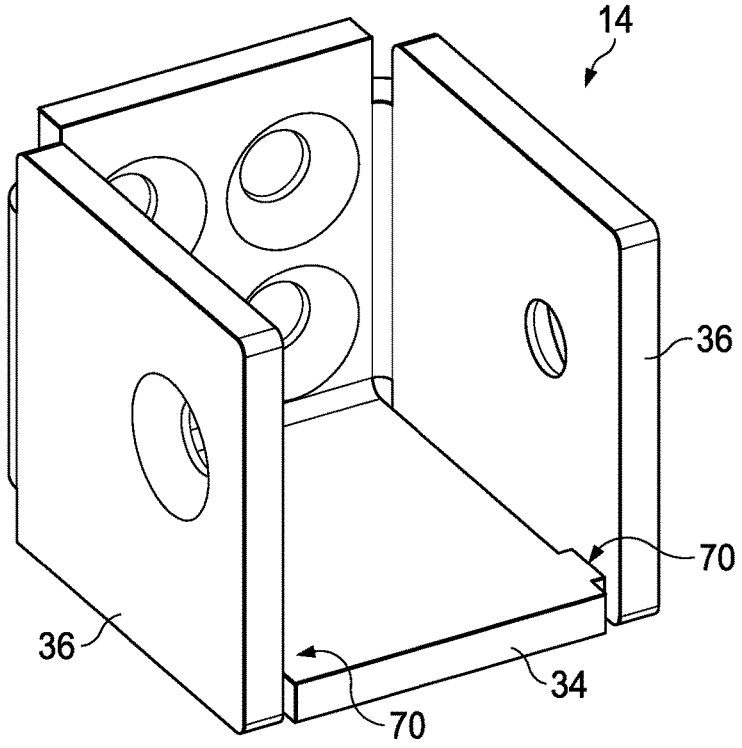

Reference is now made to FIGS. 8 and 9 which show isometric views of the cup 14. In this alternate embodiment, the cup 14 is reinforced with a pair of tack welds 70 that connect a portion of the bottom wall 34 to each sidewall 36. This weld reinforces the cup 14 by providing additional structural strength where torque on the bottom wall 34 may be the greatest. Thus bending of the bottom wall downward away from the sidewalls is inhibited. In other embodiments, the entire bottom wall may be connected to the sidewalls or formed integrally therewith.

The cup 14 is sized to receive the end of the railing member. The railing may have a square, rectangular or circular cross-section. Exemplary sizes include inch to inch-and-a-half tubing of the type commonly used as railing members for outdoor fences and porch/stair railings.

Figure 10A:
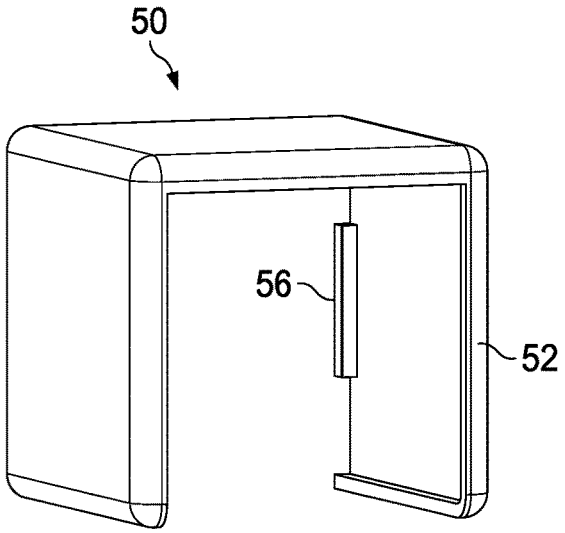
FIGS. 10A-10H illustrate views of alternative implementations for the cap.
Figure 10B:
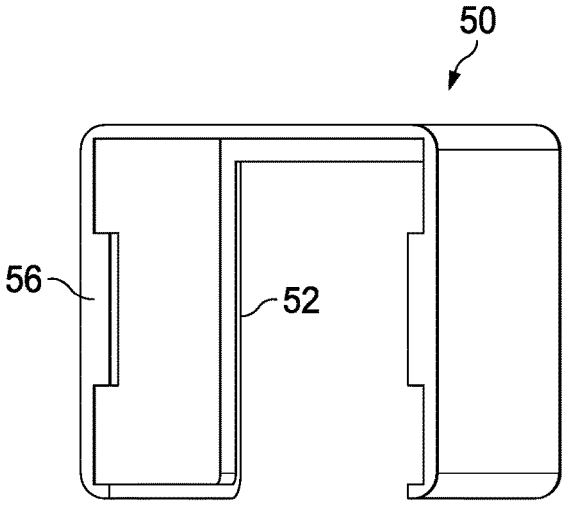
Figure 10C:
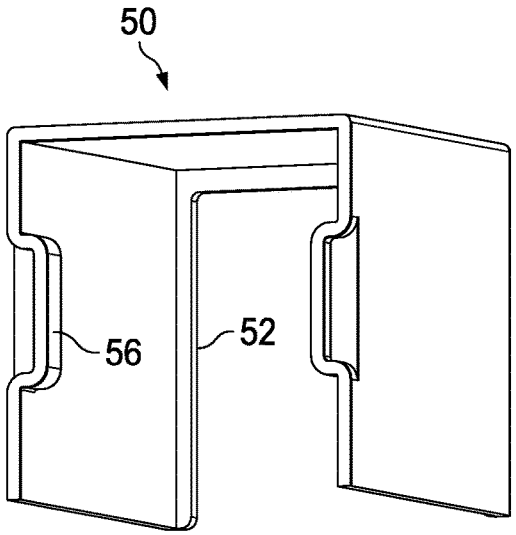
Figure 10D:
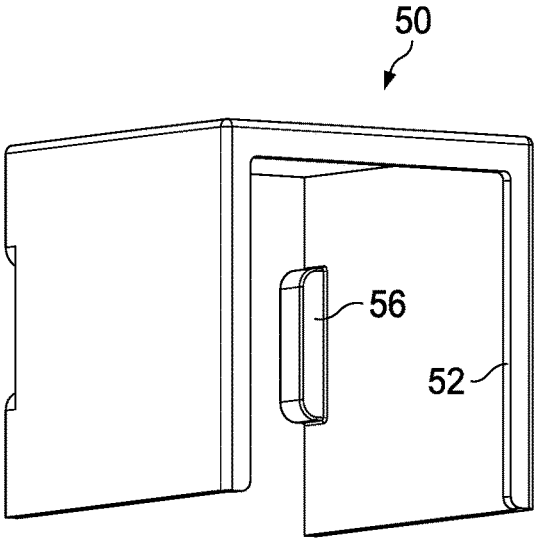
Figure 10E:
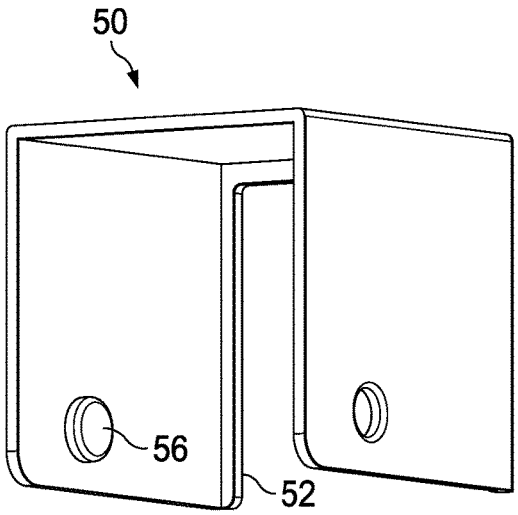
Figure 10F:
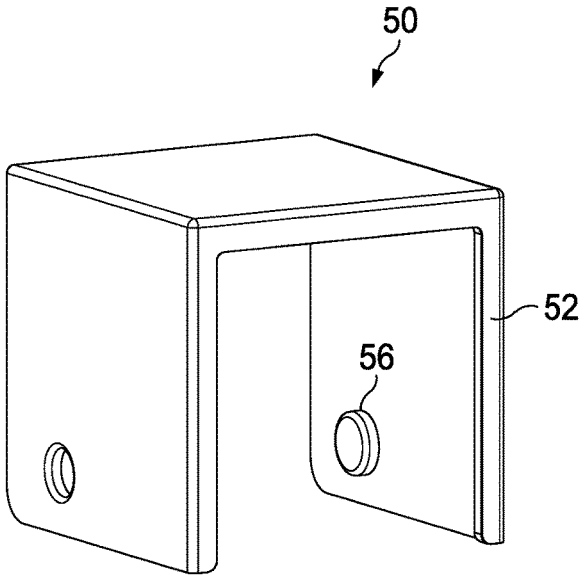
Figure 10G:
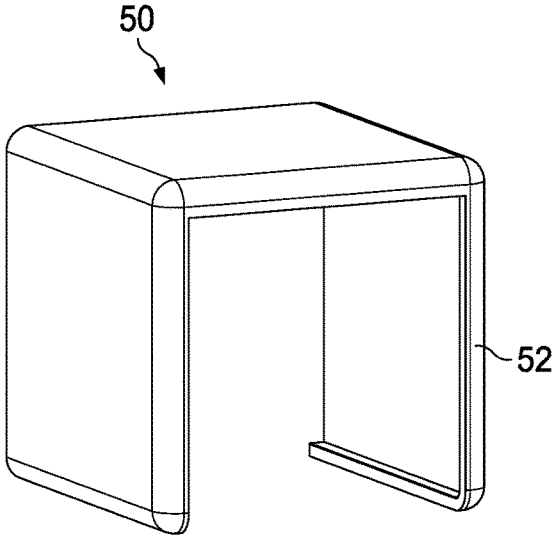
Figure 10H:
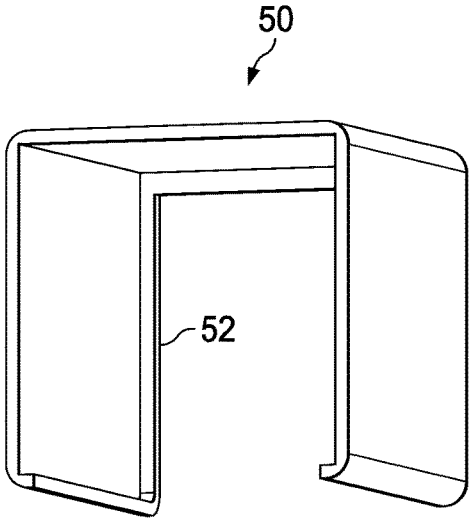

Reference is now made to FIG. 10A-10H which show views of alternative implementations for the cap 50. For example, FIGS. 10A-10B show an alternative cap implementation including inwardly extending flange portions 52 to cover edges of the cup 14 material, and the use of inwardly extending tab members 56 positioned to extend from the center of the back edge of the cap side walls (rather than from the corners as discussed above). To use this cap configuration, the notches 54 formed in the rear of the cup 14 must be correspondingly aligned with the center of back edge of the cap side walls. FIGS. 10C-10D show an alternative cap implementation similar to FIGS. 10A-10B, but with a different configuration for the inwardly extending tab members 56. FIGS. 10E-10F show an alternative cap implementation wherein the inwardly extending tab members 56 are formed as dimple structures extending from the inside surface of the cap side walls. To use this cap configuration, the notches 54 formed in the cup 14 will instead comprise apertures formed in the cup side walls 36 that correspondingly align with the location of the dimples. FIGS. 10G-10H show an alternative implementation where the cap 50 does not use inwardly extending tab members 56. In this implementation, the cap is preferably sized and shaped to be friction secured to cup. The included tab members 56 in any implementation may be formed in the cap by stamping, pressing, molding or other well known techniques.

The design disclosed herein presents the following advantages:

The bracket supports a drop in installation—this is a significant advantage for the installer as it allows the installer to set the vertical post members, install the brackets and then drop the railing, panel or other structure into place. This obviates concerns with having a loose panel and loose brackets, and having to fight to secure all the components. This also supports installation with the use of fewer personnel and with an easier and quicker installation and assembly time.

The use of the cap presents an installation with no visible fasteners. This also allows the cut ends of a railing, panel or other structure to be hidden along with the spaces that would exist between bracket and rails. The cap further has a "snap fit" assembly that locks securely in place with no need for fasteners, adhesive, welding or anything else. The cap can further be used from the top of the cup on installations without a wood top cap (over the railing) and from the bottom for installations with a wood top cap.

Universality—the same bracket is used for right, left, up, down and straight installation. The same bracket is used with a top cap and without. This is a significant benefit in distribution as well as ease of ordering for the installer or consumer.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A railing bracket, comprising:

a cup having a bottom wall, a first side wall, a second side wall disposed opposite the first side wall, and a notch;

wherein the first side wall defines a first countersunk through hole configured to receive a fastener;

a cap having a top wall, a first lateral wall, a second lateral wall, and a tab, wherein the cap has a U-shape configured to expose the bottom wall of the cup; and wherein the first lateral wall is configured to cover a head of the fastener and the notch is configured to receive the tab;

wherein the cap is configured to be attached to the cup in an overhead configuration and an underneath configuration, the overhead configuration includes the top wall of the cap disposed above the bottom wall of the cup and the first and second side walls of the cup disposed between the top wall of the cap and the bottom wall of the cup, and the underneath configuration includes the top wall of the cap disposed underneath the bottom wall of the cup.

2. The railing bracket of claim 1 wherein the cup is sized to receive a rail member having a one-inch square cross section.

3. The railing bracket of claim 1 wherein the cup is metal.

4. The railing bracket of claim 1 wherein the cap is metal.

5. The railing bracket of claim 1 wherein the cup further comprises a back wall, the back wall defining at least one through hole.

6. The railing bracket of claim 5 further comprising a vertical post, wherein the cup is configured to be secured to the vertical post.

7. The railing bracket of claim 6 wherein the cup is secured to the vertical post by a post fastener received in the at least one through hole in the back wall.

8. The railing bracket of claim 1 wherein the notch is a first notch and the tab is a first tab, the cap further comprising a second tab and the cup further comprising a second notch configured to receive the second tab.

9. A railing bracket, comprising:

a cup defined by a bottom wall, a first side wall and a second side wall, the cup being configured to receive an end of a railing member;

wherein either the first or the second side wall defines a first through hole, the first through hole configured to receive a fastener to secure the end of the railing member within the cup;

wherein the cup defines at least one notch;

a cap adapted to cover the cup, the cap having a top wall, at least one tab, and a pair of lateral walls adapted to cover the fastener received by the first through hole, the cap having a U-shape configured to expose the bottom wall of the cup; and wherein the at least one tab is configured to be received by the at least one notch;

wherein the cap is configured to be attached to the cup in an overhead configuration and an underneath configuration, the overhead configuration includes the top wall of the cap disposed above the bottom wall of the cup and the first and second side walls of the cup disposed between the top wall of the cap and the bottom wall of the cup, and the underneath configuration includes the top wall of the cap disposed underneath the bottom wall of the cup.

10. The railing bracket of claim 9 wherein the cup further comprises a rear wall.

11. The railing bracket of claim 10 wherein the rear wall further comprises at least one through hole and wherein the fastener is a first fastener and the at least one through hole defined by the rear wall is configured to receive a second fastener.

12. The railing bracket of claim 9 wherein the cup is secured to a vertical post.

13. The railing bracket of claim 9 wherein the cup is sized to receive an end of a railing member having a one-inch square cross section.

14. The railing bracket of claim 9 wherein the cup is made of metal.

15. The railing bracket of claim 9 wherein the cap is made of metal.

16. The railing bracket of claim 9 wherein the fastener is a screw.

17. A post for supporting a rail panel, comprising:

a vertical member;

a first cup secured to the vertical member;

a second cup secured to the vertical member and disposed vertically spaced apart from the first cup;

wherein each of the first and second cups comprises a bottom wall, a first side wall defining a through hole, a second side wall, and a notch, the first cup configured to receive an end of a first railing member secured within the first cup by a fastener received through the through hole of the first cup and the second cup configured to receive an end of a second railing member secured within the second cup by a fastener received through the through hole of the second cup;

a first cap adapted to cover the first cup, the first cap having a U-shape configured to expose the bottom wall of the first cup, the first cap having a top wall, a first lateral wall and a second lateral wall, the first lateral wall adapted to cover at least a portion of the fastener received by the through hole of the first cup, and a first tab, wherein the first tab is configured to be received by the notch of the first cup; and a second cap adapted to cover the second cup, the second cap having a U-shape configured to expose the bottom wall of the second cup, the second cap having a top wall, a first lateral wall and a second lateral wall, the first lateral wall adapted to cover at least a portion of the fastener received by the through hole of the second cup, and a second tab, wherein the second tab is configured to be received by the notch of the second cup;

wherein the first cap is configured to be attached to the first cup in an overhead configuration and an underneath configuration, the overhead configuration includes the top wall of the first cap disposed above the bottom wall of the first cup and the first and second side walls of the first cup disposed between the top wall of the first cap and the bottom wall of the first cup, and the underneath configuration includes the top wall of the first cap disposed underneath the bottom wall of the first cup.

18. The post of claim 17 wherein at least one of the first or second cups are welded to the post.

19. The post of claim 17 wherein each of the first and second cups further comprises a back wall defining a plurality of through holes.

20. The post of claim 19 wherein each of the first and second cups is secured to the post with a plurality of fasteners received through the plurality of through holes.

* * * * *